United States Patent [19]

Arthur

[11] 4,419,546

[45] Dec. 6, 1983

[54] ROTARY SWITCH

[75] Inventor: Ronald H. Arthur, Lauderhill, Fla.

[73] Assignee: Illinois Tool Works Inc., Chicago, Ill.

[21] Appl. No.: 342,030

[22] Filed: Jan. 22, 1982

[51] Int. Cl.[3] ..... H01H 19/54

[52] U.S. Cl. ..... 200/11 G; 200/11 K; 200/291

[58] Field of Search ..... 200/11 R, 11 A, 11 G, 200/11 H, 11 J, 11 K, 14, 291, 336

[56] References Cited

U.S. PATENT DOCUMENTS

| | | | |
|---|---|---|---|
| 2,834,842 | 5/1958 | LeBeau | 200/11 K |
| 2,980,770 | 4/1961 | Nabstedt | 200/11 A |
| 3,261,930 | 7/1966 | Sorenson | 200/11 G |
| 3,300,594 | 1/1967 | Paine et al. | 200/11 G |
| 3,311,718 | 3/1967 | Allison et al. | 200/11 K |
| 3,699,279 | 10/1972 | Lockard et al. | 200/11 G |
| 3,736,390 | 5/1973 | Lockard | 200/11 G |
| 3,803,370 | 4/1974 | Garcia | 200/11 J |

FOREIGN PATENT DOCUMENTS

| | | | |
|---|---|---|---|
| 2411480 | 8/1979 | France | 200/336 |

*Primary Examiner*—J. R. Scott

*Attorney, Agent, or Firm*—Donald D. Mondul; Thomas W. Buckman

[57] ABSTRACT

A multiposition rotary switch including a detent mechanism wherein a resilient plastic ring having radially extending detent bumps engage cam surfaces on the inside walls of the switch casing. The detent ring is mounted on the contact carrier by means of downwardly projecting tabs which fit into corresponding radial slots in the contact carrier so that the detent ring is keyed thereto and rotatable with the contact carrier. An arcuate formed spring metal contact-wiper is keyed to the contact carrier for corresponding rotation therewith.

7 Claims, 25 Drawing Figures

FIG. 7A
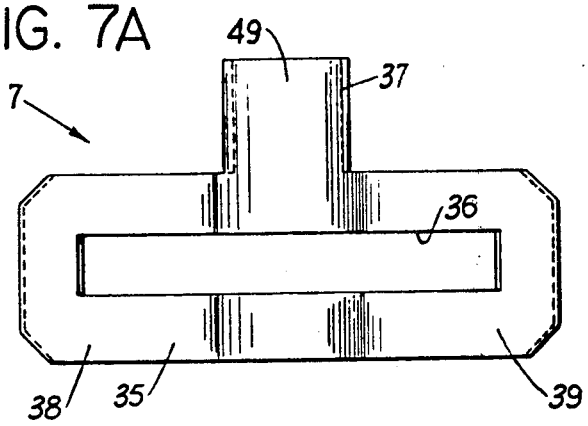
FIG. 8A
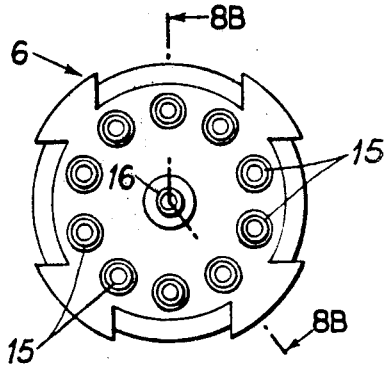
FIG. 7B
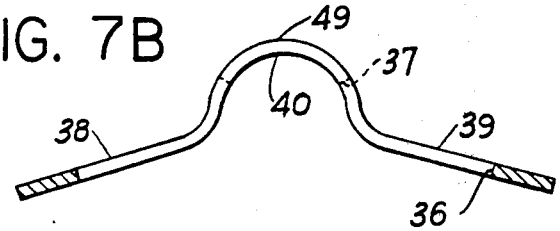
FIG. 8B
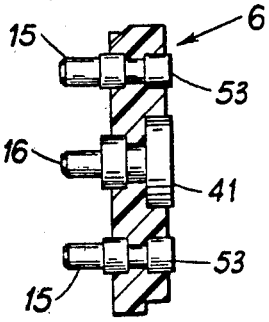
FIG. 7C
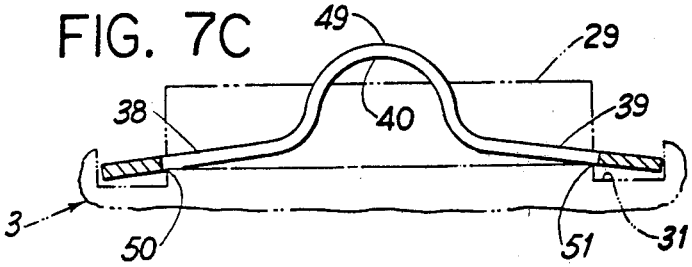
FIG. 9
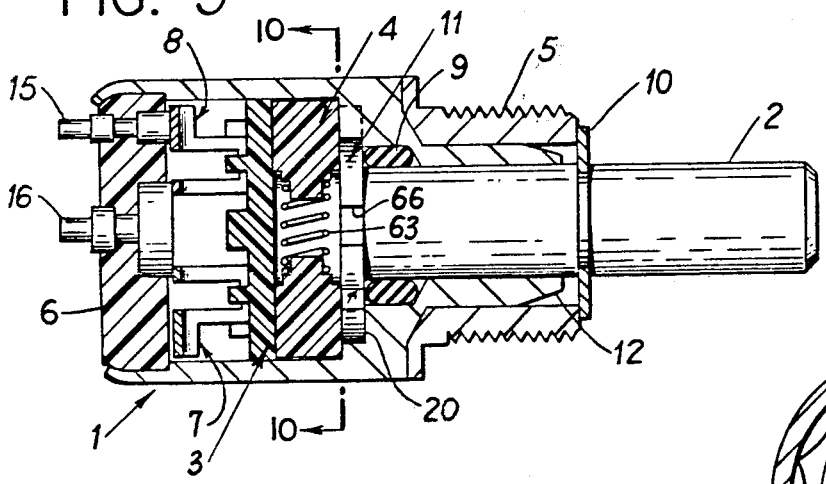
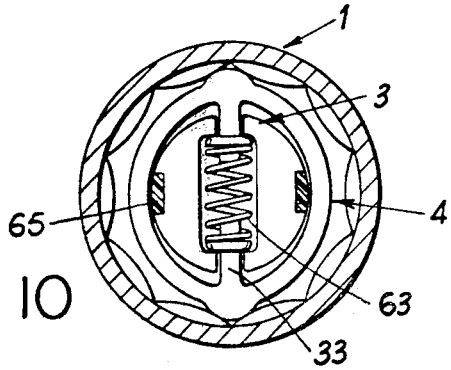
FIG. 10

ROTARY SWITCH

BACKGROUND OF THE INVENTION

The invention relates to new and improved switches of the rotary type and having a plurality of positions.

It is desirable in multi-position switches and particularly those having a rotary motion to have a positive position indexing to assure positive electrical continuity in each switch position. Such position indexing has been accomplished in the prior art predominately by the utilization of detent mechanisms such as those employing a ball and spring which engage cam like piece members, or alternatively a leaf spring engaging a ball or having a ball like member formed therein which engages cam like piece members. In either event it is apparent that such mechanisms are quite complex, particularly when incorporated into a miniature switch, which necessarily increases the cost of manufacturing.

PRIOR ART STATEMENT

In one prior art device, such as described in U.S. Pat. No. 3,300,594 issued Jan. 24, 1967, to Bud A. Paine et al., the rotor member includes a central body portion having fixed thereto and formed integrally therewith a cantilevered beam member which carries a detent. As the rotor is actuated, the beam is flexed and bent at a relatively small regionalized stress point. It is evident that flexing at a stress point may, and generally will, cause structure fatigue that can result in a failure of the device.

Other prior art patents of interest include: U.S. Pat. Nos. 3,159,722 issued Dec. 1, 1964 to J. M. Cobb et al.; 3,244,821 issued Apr. 5, 1966 to M. H. Smith et al.; 2,530,006 issued Feb. 26, 1948 to G. S. Ellithorpe; and 3,297,836 issued Feb. 24, 1966 to T. J. O'Malley.

The above patents are noted as being representative of the prior at and other pertinent references may exist. None of the above noted patents are deemed to affect the patentability of the present claimed invention.

In contrast to the prior art, the present invention provides a multiposition rotary switch having a detent mechanism which includes a ring or oval shaped resilient detent with radially extending detent bumps. And a contact-wiper formed of spring metal to have spring arms which meet at an arcuate vertex contact surface may be keyed to the contact carrier or rotor for corresponding rotation therewith.

SUMMARY OF THE INVENTION

A rotary multi-position switch generally comprising:

a housing 1 defining a cavity;

a plurality of inwardly directed detent channel means 13 within said cavity;

a rotor 3 rotatably positioned within said cavity;

a resilient detent ring 4 keyed to the rotor 3 for rotation therewith, and having radially extending detent bumps 14 at generally diametrically disposed positions thereon for engagement with said detent channel means 13;

a bridging contact 7 and/or 8 keyed to the rotor for rotation therewith;

two stationary spaced apart contact means 15 adapted to be engaged by the bridging contact in a rotational position of the rotor; and actuator means 2 for rotating said rotor from without the housing.

Accordingly it is an object of the present invention to provide a new and improved switch having a highly advantageous and economical detent arrangement.

Another object of the present invention to to provide a miniature multi-position rotary switch which is inexpensive, extremely small, and rugged in construction.

A further object of the present invention is to provide a rotary switch having a new and improved movable contact/rotor assembly.

Another object of the present invention is to provide a convenient means of varying detent feel and operating torque while providing greater line contact between the detent contacting surfaces.

BRIEF DESCRIPTION OF THE DRAWINGS

Further objects and advantages of the present invention will appear from the following description, of the accompanying drawings. Similar reference numerals refer to similar parts throughout.

FIG. 7A is a top view of the contacts shown in FIG. 1;

FIG. 7B is a side view of the contacts;

FIG. 7C is a side view of the contacts shown in their compressed or biased position with respect to the contact carrier fixture phantom outline;

FIG. 8A is a top view of the end plate with stationary contacts; and

FIG. 8B is a section view taken on line 8B—8B of FIG. 8A.

FIG. 9 is a cross sectional view of another embodiment of the invention;

FIG. 10 is a sectional view taken on line 10—10 of FIG. 9;

DETAILED DESCRIPTION OF THE INVENTION

Figure 1:
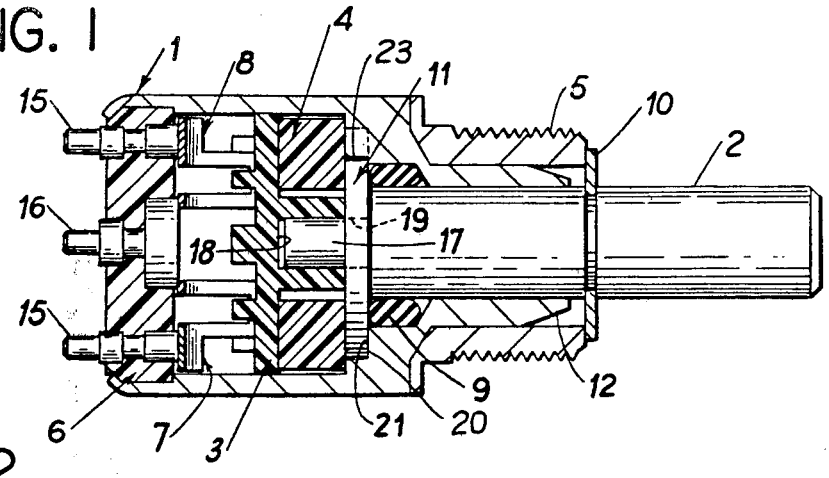
FIG. 1 is a cross sectional view of a miniature rotary switch assembly in accordance with the invention.

Referring to the drawings, particularly FIG. 1, the preferred embodiment of the invention comprises a multiposition miniature rotary switch having a housing 1, a shaft 2, a contact carrier 3, a spring detent ring 4, a sleeve 5, a terminal assembly 6, two movable contacts 7 and 8, an "O" ring 9, a retaining ring 10, and a four position stop disc 11.

One end of the housing 1 has a threaded tubular sleeve 5 extending about a tubular extention 12 of the housing 1. The tubular sleeve 5 may have flat surfaces for cooperating with flat surfaces of a mounting hole in a panel (not shown) for mounting the switch. The flat surfaces are provided to prevent the switch from rotating with respect to the panel with rotation of the shaft 2 during a turning action thereof.

Figure 2:
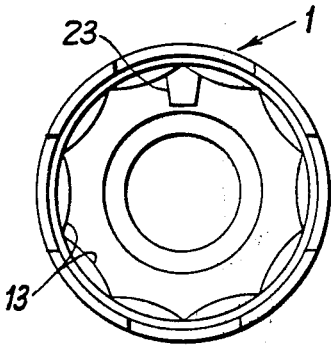
FIG. 2 is an end view showing the stop pin and cam inner surface of the housing.

The inner wall surface of the housing 1 contains a recessed portion for receiving an "O" ring 9 therein which provides a gasket function between the shaft 2 and the housing 1. The interior wall of the housing 1 also contains a plurality of inwardly directed detents or cam surfaces 13 (FIG. 2) which cooperate with radially extending detent bumps 14 formed on the resilient detent ring 4 for holding the shaft 2 and, therefore, switch wipers 7 and 8 in a fixed tactile position relative to the housing 1. A stop tooth 23 is formed integrally as part of the housing 1. The other end of the housing 1 is open to permit insertion of the switch components during assembly and is, for example, rolled over or crimped on an end plate or terminal assembly 6 made of insulating material such as plastic or a glass filled material. Contacts 15 and 16 are affixed in the end plate 6 and have contact surface portions on the interior and exterior areas of the switch 12.

The shaft 2 is mounted in the opening in the tubular extention 12 for rotational movement and has a key or tab end portion 17 which is inserted within a keyway recess 18 in the contact carrier or rotor 3. The shaft 2 contains an annular groove (not shown) for receiving a retaining ring or C-clip 10 therein.

Figure 3:
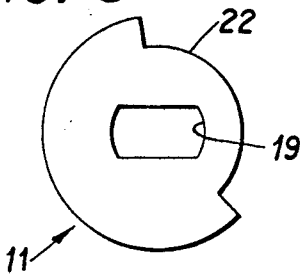
FIG. 3 is a top view of a four position stop ring.
Figure 4:
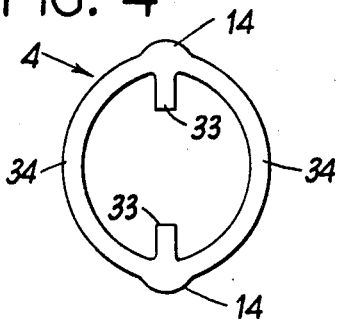
FIG. 4 is a top view of the detent ring in accordance with the invention.
Figure 5B:
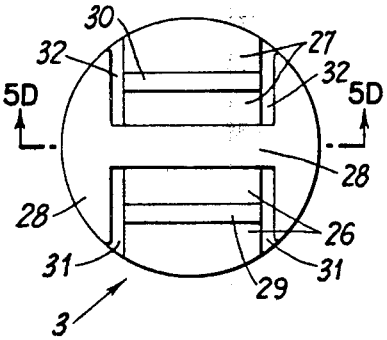
FIG. 5B is an end view of the contact carrier shown in FIG. 5A.
Figure 5A:
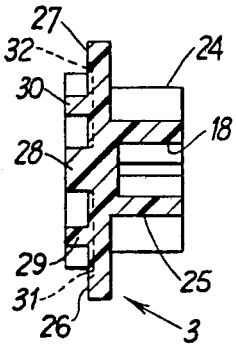
FIG. 5A is a cross sectional view of the contact carrier in accordance with the invention.
Figure 5C:
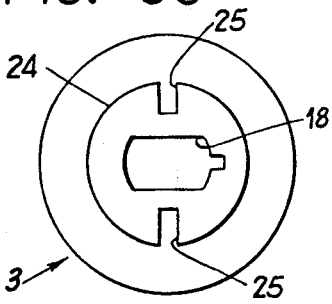
FIG. 5C is another end view of the contact carrier of FIG. 5A.
Figure 5D:
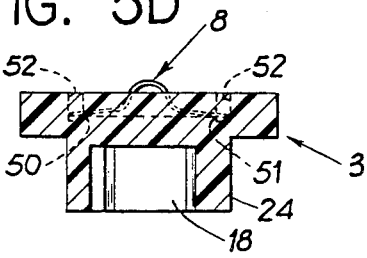
FIG. 5D is a sectional view taken on line 5D—5D of FIG. 5B with a contact positionally shown therein.

The stop disc 11 (FIG. 3) contains a keyway opening or hole 19 adapted to receive therein the key end portion 17 of the shaft 2 and is affixed to the shaft 2 by any conventional means such as by staking. The side walls 20 of the stop disc 11 abut against a shoulder portion 21 of the housing 1. The stop disc 11 has an annular segment of reduced radius or cut-out 22 which cooperates with the stop tooth 23 to define the permitted angle of rotation of the shaft 2. It being understood that the stop tooth 23 projects from a portion of the housing 1, for example, shoulder portion 21, into the spacing (not shown) formed by the cut-out 22 with the stop disc 11 being interposed between the detent ring 4 and the shoulder portion 21 (FIG. 1).

With reference to FIGS. 1, 5A, 5B, 5C and 5D, it can be seen that the contact carrier 3 includes a keyway or recess 18 having flat sides for accommodating the flat surfaces of the key end portion 17 of the shaft 2. The contact carrier 3 is rotatably mounted within the housing 1 and is positionally held between the detent ring 4 and the end plate 6.

The contact carrier 3 contains a neck portion 24 which is received in the opening of the detent ring 4 as will be discussed in greater detail below, with diametrically disposed radial channels 25. As noted above, neck portion 24 also contains a keyway 18 for being engaged by the key end 17 of the shaft 2. The other end of the contact carrier 3 contains two ledge portions 26 and 27 recessed between wall portions of a generally "H" shaped projection 28 of the contact carrier 3. Each ledge portion 26 and 27 includes an elongate generally rectangular upthrust or wall portion 29 and 30, respectively, adapted to fit within and be keyed to a respective rectangular opening in the contacts 7 and 8. Each ledge portion 26 and 27 is also bordered on two sides, adjacent the ends of wall portions 29 and 30, by a pair of spaced apart generally parallel grooves or gutters 31 and 32. The flat sides of the key end portion 17 of shaft 2 engages the flat sides of keyway 18 of the rotor 3 to cause rotational movement of the rotor 3 with rotation of the shaft 2.

The rotor 3 is rotatable to a plurality of switch positions, with rotation of shaft 2 and is detented and located in each switch position by means of a novel detent arrangement. The detent arrangement includes a spring plastic detent ring 4 having a pair of radially exending detent bumps 14 at diametrically disposed positions thereon for engagement with the cam surfaces 13 on the inside walls of the switch casing 1. The detent ring 4 is mounted on the neck portion 24 of the rotor 3 such that each of the two inwardly projecting pins or tabs 33 are received in and keyed to a respective slot 25 in the neck portion 24. The tabs 33 and detent bumps 14 are generally aligned with the diametrically disposed slots 25 on a common axis. And the detent ring 4 has a generally oval shape with its long diameter axis generally aligned with the common axis of the slots 25, tabs 33 and detent bumps 14. The detent ring 4 may be formed from a suitable plastic compound, such as "DELRIN 500," to provide a spring action when compressed or inwardly deflected. It being understood that the inner diameter of the detent ring 4, particularly along its long diameter oval axis, is greater than the diameter of neck portion 24. With the detent bumps 14 being cammed or urged downwardly toward each other when engaged by cam surfaces 13 of the housing 1, the key tabs 33 are urged deeper within the respective keyway slots 25 resulting in the outward bowing of side walls 34 of the detent ring 4. In this manner, the flexing and spring biasing force of the detent ring 4 are substantially distributed and realized over the entire oval structure to effect the desired diametrically opposing outward spring bias to the detent bumps 14 when the engaged by the cam surfaces 13 on the inside wall of the housing 1. The tabs 33 and slots 25 serve the dual function of keying the detent ring 4 to the rotor 3 for rotation therewith and also serves as an axial guide for the detent bumps 14 with inward-outward translation thereof upon engagement with the detent cams-channels 13. It is appropriate at this time to note that the term "detent ring" is used throughout to mean a detent structure having a generally circular or oval configuration with a central hole therein. And its long diameter is greater than the diameter of the neck member 24 to enable clearance for the detent bumps to be cammed in a downward direction.

Figure 6A:
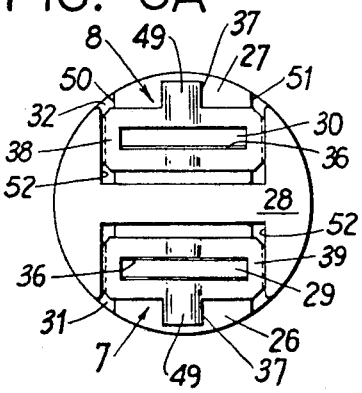
FIG. 6A is a partial top elevational view of the contact carrier with two contacts surmounted thereon.
Figure 6B:
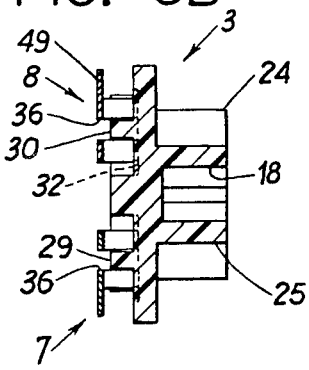
FIG. 6B is a side view of the contact carrier and the surmounted contacts thereon.
Figure 11:
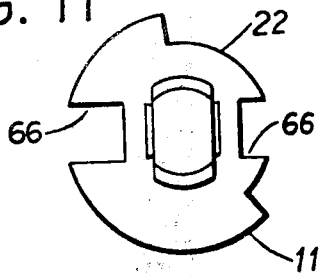
FIG. 11 is a top view of a stop ring.
Figure 12:
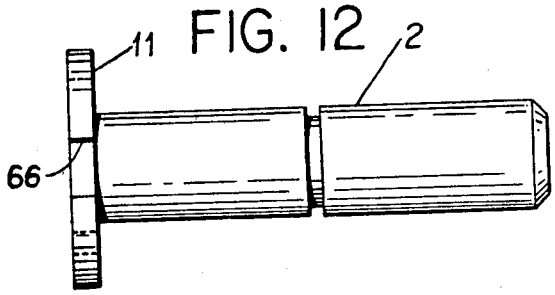
FIG. 12 is a side view of the shaft and the stop ring affixed thereto.
Figure 13:
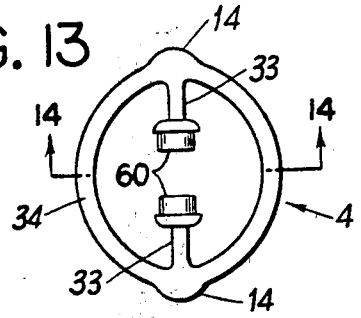
FIG. 13 is a top view of an alternative embodiment of accordance with the invention.
Figure 14:
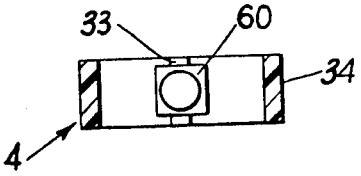
FIG. 14 is a sectional view taken on line 14—14 of the detent ring shown in FIG. 13.
Figure 15:
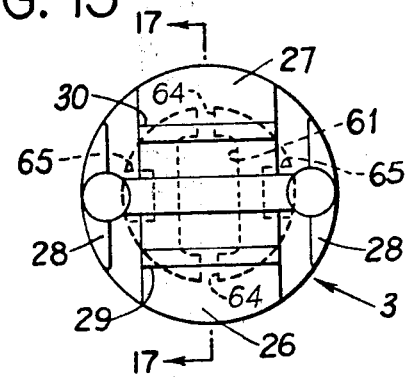
FIG. 15 is an end view of the contact carrier shown in FIG. 9.
Figure 16:
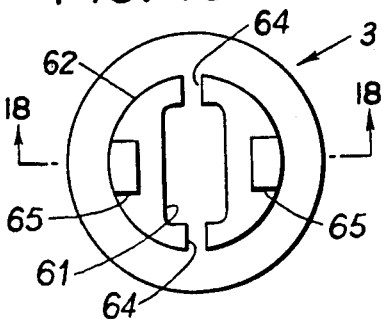
FIG. 16 is the other end view of the contact carrier shown in FIG. 15.
Figure 17:
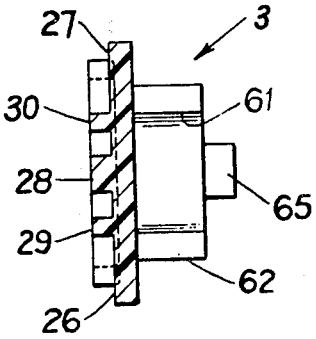
FIG. 17 is a sectional view taken on line 17—17 of FIG. 15.
Figure 18:
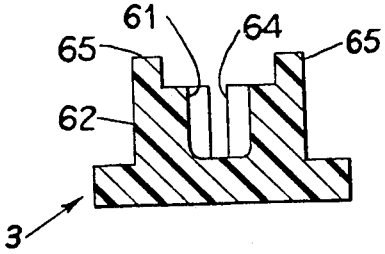
FIG. 18 is a sectional view taken on line 18—18 of FIG. 16.

With reference particularly to FIGS. 6 and 7, it is seen that the contacts 7 and 8 each have a generally rectangular body portion 35 with an elongate window 36 therein and a contact tab 37. The contacts 7 and 8 are formed, for example, from a thin, flat, electrically conductive spring metal having inclined arms 38 and 39 which meet at a vertex in the form of a convex boss or inverted U-shaped central portion 40 which includes the contact tabs 37. The two arms 38 and 39 extend outwardly and downwardly.

The contacts 7 and 8 each are located between the contact carrier or rotor 3 and terminal assembly 6. As noted above, the window 36 forms a keyway for receiving a respective elongate guide wall 29 and 30 therein. In this manner, the contacts 7 and 8 are keyed with the contact carrier for rotation therewith. Each end portion 38 and 39 of the contacts 7 and 8 are generally pivoted on an edge or corner ledge 50 and 51, respectively, formed between the spaced gutters 31 and 32 and interposed ledge surfaces 26 and 27. The contacts 7 and 8 are dimensioned such that their ends overhang corner ledges 50 and 51 and project generally within the gutters, while being spaced from the side walls 52 of the "H" shaped wall projection 28 to, thereby, enable an outward spread of the ends 38 and 39 when the contacts 7 and 8 are compressed between the contact carrier 3 and terminal assembly 6. During switch rotation, these ends 38 and 39 are generally free to pivot on the respective corner ledges 50 and 51 and flex within the gutters so as to provide a yielding spring bias on contact tab 37 when in engagement with a terminal 15. As noted above, the contact tabs 37 have an upper cam surface 49 which is urged inwardly of the assembled switch when engaged by a button projection 53 at the interior section of the terminal 15, which causes a further compression of contacts 7 and 8 between the contact carrier 3 and terminal assembly 6. The height of the contacts 7 and 8 contrasted between its uncompressed state without the switch and compressed within the switch is depicted by FIGS. 7B and 7C, repsectively.

The curved upper surface of the body portion 35 is contoured to be in engagement with the inner contact surface 41 of the central terminal 16.

The terminal assembly 6 is made of an insulating material such as plastic. Terminals 15 and 16 are affixed in the terminal assembly 6 and have contact portions on the interior and exterior areas of the housing 1. Terminal 16 is centrally positioned and has a relatively large contact surface which is maintained in electrical contact with the curved body portion 49 of the contacts 7 and 8 under spring bias of the spring arms 38 and 39 with being compressed between the terminal assembly 6 and the contact carrier 3. A plurality of terminals 15 may be affixed to the terminal assembly 6 circumferentially thereon and about the central terminal 16 and positioned such that the curved surface of the contacts 7 and 8 will bridge, i.e., contact, the central terminal 16 and a respective circumferentially disposed terminal 15 in a switch position. The terminal assembly 6 may be affixed to the housing 1 by conventional means such as crimping or rolling over the end walls of the housing 1 on the terminal assembly 6.

With refernce to FIGS. 9–18, another embodiment of the invention is illustrated. The embodiment shown in these drawings is similar to the embodiment described in connection with FIGS. 1–8, with the exception that the inwardly projecting pins 33 have caped ends or spring retaining head portions 60 which extend from pins 33 within a cavity 61 formed within collar 62, and by also having a helical spring 63 which is compressed between the spring retaining head portions 60.

The contact carrier 3 is generally similar to that which is shown in FIGS. 1–8, except that it includes a modified collar 62 having two diametrical passageways 64 which open into cavity 61, and having two projecting key-tabs 65. The key-tabs 65 project into a respective keyway 66 in the stop disc 11 and are rotated with rotation of the stop disc 11. The stop disc 11 is affixed to the shaft 2.

The alternative embodiment of the detent ring 4, as noted above, includes two spring retaining head portions 60 which are upwardly and downwardly received within cavity 61.

Each end of a helical spring 63 is mounted to a respective spring retaining head portion 60 and compressed therebetween. Thus, by modifying the component parts, as described above, to accommodate a helical compression spring 63 trap mounted within cavity 61 between head portions 60, it is possible to provide a spring reinforced or varied spring bias directed outwardly towards the two detent bumps 14. In this manner, a spring force can be provided to reduce or prevent the possibility of the plastic ring from taking a set, i.e., losing pretension, and also compensate for dimensional changes due to wear of the detent bumps 14. The compression spring force may be selected to provide a desired detent (tactile) force and operating torque required for specific applications.

While two specific preferred embodiments have been set forth for the invention for the sake of illustration of persons skilled in the art, they are not intended to be limitative.

I claim:

1. A rotary multi-position switch comprising:

a housing defining a cavity;

a plurality of inwardly directed detent channel means within said cavity;

a rotor rotatably positioned within said cavity;

a resilient detent ring keyed to the rotor for rotation therewith, and having radially extending detent bumps at generally diametrically disposed positions thereon for engagement with said detent channel means;

a bridging contact keyed to the rotor for rotation therewith;

two stationary spaced apart contact means adapted to be engaged by the bridging contact in a rotational position of the rotor;

actuator means for enabling rotation of said rotor from outside the housing, said rotor including a first end in opposed facing relation with said stationary contacts and containing two ledge portions, each of said two ledge portions being recessed between walls of a generally H shaped projection, each of said ledge portions including an elongate generally rectangular key wall extension and a gutter adjacent the ends of each said key wall extension, the other end of the rotor containing a generally round neck member projection having two diametrically disposed keyway slots therein, and said bridging contact including two spring arms which meet at a vertex in the form of a convex boss which includes a contact tab portion, said arms extending outwardly and downwardly from the convex boss, said briding contact having a keyway opening therein dimensioned to receive said key wall extension of the rotor.

2. A switch as in claim 1, wherein:

the bridging contact is dimensioned to be compressed between the rotor and the stationary contacts in a switch position.

3. A rotary multi-position switch comprising a housing defining a cavity, said cavity having detent means for contributing to tactile indication of operation of the switch; a rotor rotatably positioned within said cavity; a plurality of bridging contacts, said rotor having at a first end a plurality of contact positioning means for registering each of said plurality of bridging contacts with respect to said rotor; a resilient detent means for contributing to said tactile indication, said resilient detent means having a generally ovate ring shape, a plurality of detent bumps about the outer periphery of said resilient detent means, and a plurality of arm means for keying said resilient detent means with said rotor extending from the inner periphery of said resilient detent means toward the axis of said resilient detent means, said rotor having at a second end a neck means for registering said resilient detent means with said rotor, said neck means being dimensioned to be received within said resilient detent means, said neck means having a plurality of channel means dimensioned for receiving said arm means therein to effect said keying; a plurality of stationary contact means located within a first end plate of said cavity in spaced facing relationship to said first end of said rotor, said plurality of stationary contact means being electrically accessible from outside said housing and being spatially related to engage said plurality of bridging contacts as said rotor is rotated, each of said plurality of bridging contacts being formed to have a spring characteristic, each of said plurality of bridging contacts being shaped to cooperate with said plurality of contact positioning means to effect rotational movement of said rotor; said resilient detent means, said rotor and said plurality of bridging contacts moving substantially as a unitary assembly, said plurality of bridging contacts being held captive between said rotor and said first end plate with sufficient compressive force to ensure that said plurality of bridging contacts effects electrical contact with selected of said plurality of fixed contacts as said rotor is rotated, and said plurality of detent bumps interactive with said plurality of said detent means during rotation of said rotor to produce said tactile indication of operation of the switch.

4. A rotary multi-position switch as recited in claim 3, wherein said plurality of bridging contacts is two bridging contacts, said plurality of detent bumps is two detent bumps, said plurality of arm means is two arm means, and said two detent bumps and said two arm means are positioned as two diametrically opposed pairs, each of said pair comprising one detent bump and one arm means.

5. A rotary multi-position switch as recited in claim 4, wherein the switch further comprises a spring compressed between said two arm means whereby said two arm means are outwardly biased and said tactile indication of operation of the switch is enhanced.

6. A rotary multi-position switch comprising:

a housing defining a cavity and having wall portions with a plurality of inwardly directed detent cam means projecting within said cavity;

a rotor rotatably positioned within said cavity having a first end surface with two spaced apart generally parallel walls projecting therefrom and a neck member of reduced diameter defining a second end, said neck member having two diametrically disposed channel means and a keyway opening in the end of said neck member;

a shaft journaled to said housing for rotational movement and having a tab at the interior end thereof adapted to fit within and engage said keyway opening to effect rotation of said rotor, and an actuator end portion projecting outwardly from the housing;

a resilient plastic detent ring having an oval shape with a hole therein dimensioned to receive said neck member and having two radially extending detent bump means at substantially diametrically disposed positions adjacent each peripheral vertex of the oval detent ring for engaging said detent cam means whereby said detent bumps are opposingly translated defining a plurality of switch positions, and having two inwardly projecting arm means each dimensioned to be received within and engage one of said channel means to effect rotation of the detent ring with said rotor;

a plurality of stationary contacts circumferentially spaced from and about a central contact, said stationary contacts and central contact each having a terminal contact without said housing; and two bridging contacts each having two spring arm means that meet at an arcuate vertex which defines a contact surface dimensioned to engage a stationary contact and the central contact in a switch position, each said bridging contact includes a cutout opening therein dimensioned to receive a respective wall of the rotor to effect rotation of the bridging contacts with rotation of said rotor, said briding contacts being compressed between said rotor and the central contact with the arm means engaging said first end of the rotor.

7. A switch as in claim 6, wherein:

the two detent bump means and the two arm means of the detent ring are substantially aligned with the vertex of the oval shaped detent ring.

* * * * *